US010781629B2

(12) United States Patent
Haab et al.

(10) Patent No.: US 10,781,629 B2
(45) Date of Patent: Sep. 22, 2020

(54) SLIDING ELEMENT WITH SEALING DEVICE AND SEALING ELEMENT

(71) Applicant: HAWA SLIDING SOLUTIONS AG, Mettmenstetten (CH)

(72) Inventors: Gregor Haab, Allenwinden (CH); Sascha Justl, Zürich (CH); Peter Ettmüller, Jonen (CH); Myrta Strebel, Muri (CH)

(73) Assignee: HAWA SLIDING SOLUTIONS AG, Mettmenstetten (CH)

( * ) Notice: Subject to any disclaimer, the term of this patent is extended or adjusted under 35 U.S.C. 154(b) by 177 days.

(21) Appl. No.: 15/928,919

(22) Filed: Mar. 22, 2018

(65) Prior Publication Data

US 2018/0274285 A1 Sep. 27, 2018

(30) Foreign Application Priority Data

Mar. 23, 2017 (EP) ..... 17162591

(51) Int. Cl.
*E06B 7/23* (2006.01)
*E06B 3/46* (2006.01)
(Continued)

(52) U.S. Cl.
CPC ..... *E06B 7/2309* (2013.01); *E06B 3/4636* (2013.01); *E06B 7/2316* (2013.01); *E05D 15/063* (2013.01); *E05D 15/0652* (2013.01); *E05D 15/56* (2013.01); *E05Y 2201/688* (2013.01); *E05Y 2800/102* (2013.01); *E05Y 2800/12* (2013.01); *E05Y 2900/132* (2013.01);
(Continued)

(58) Field of Classification Search
CPC ..... E06B 7/2309; E06B 7/2316
See application file for complete search history.

(56) References Cited

U.S. PATENT DOCUMENTS 3,140,517 A * 7/1964 Richter ..... E06B 7/2309 49/489.1
3,388,502 A * 6/1968 Ceyer ..... B61D 19/009 49/493.1
(Continued)

FOREIGN PATENT DOCUMENTS

DE 42 28 986 A1 3/1994
EP 1 431 501 A2 6/2004
EP 2 685 039 A2 1/2014

OTHER PUBLICATIONS

Sep. 22, 2017 Extended Search Report issued in European Patent Application No. 17162591.6.

*Primary Examiner* — Catherine A Kelly
(74) *Attorney, Agent, or Firm* — Oliff PLC

(57) ABSTRACT

The sliding element includes a sliding plate and a sealing device that includes at least one sealing element, which forms a sealing frame that is arranged on a rear side of the sliding plate and that extends peripherally along an edge of the sliding plate. The sliding plate includes a base plate and a flange plate, which is offset from the base plate, which is connected in one piece to the base plate and which is separated at its edge from the base plate by a circumferential anchor groove, which anchor groove serves for holding the at least one sealing element, which at least one sealing element includes an anchor member that is inserted into the anchor groove and that is connected via a connection body to a compression member.

14 Claims, 9 Drawing Sheets

(51) Int. Cl.
*E05D 15/56* (2006.01)
*E05D 15/06* (2006.01)
*E06B 3/62* (2006.01)

(52) U.S. Cl.
CPC ..... *E06B 2003/6223* (2013.01); *E06B 2003/6264* (2013.01)

(56) References Cited

U.S. PATENT DOCUMENTS 3,452,481 A * 7/1969 Bailey ..... B61D 19/009 49/489.1
3,518,793 A * 7/1970 Hirtle ..... E06B 7/2309 49/498.1
3,562,957 A * 2/1971 Landis ..... E06B 7/2309 49/493.1
3,616,137 A * 10/1971 Horton ..... D05C 17/02 428/88
3,758,992 A * 9/1973 Olson ..... B29C 44/5627 49/489.1
4,095,640 A * 6/1978 Beckerer, Jr. ..... E06B 3/02 114/178
4,343,110 A * 8/1982 Thompson ..... E06B 7/2318 49/477.1
4,478,003 A * 10/1984 Flett ..... E06B 3/28 49/404
4,538,380 A * 9/1985 Colliander ..... E06B 7/2314 49/475.1
4,656,783 A * 4/1987 Ahonen ..... E06B 3/44 49/404
8,474,189 B1 * 7/2013 Peterson ..... E06B 7/2314 49/479.1
9,290,977 B2 3/2016 Haab et al.
2012/0260579 A1 * 10/2012 DeMello ..... E06B 7/2309 49/477.1

* cited by examiner

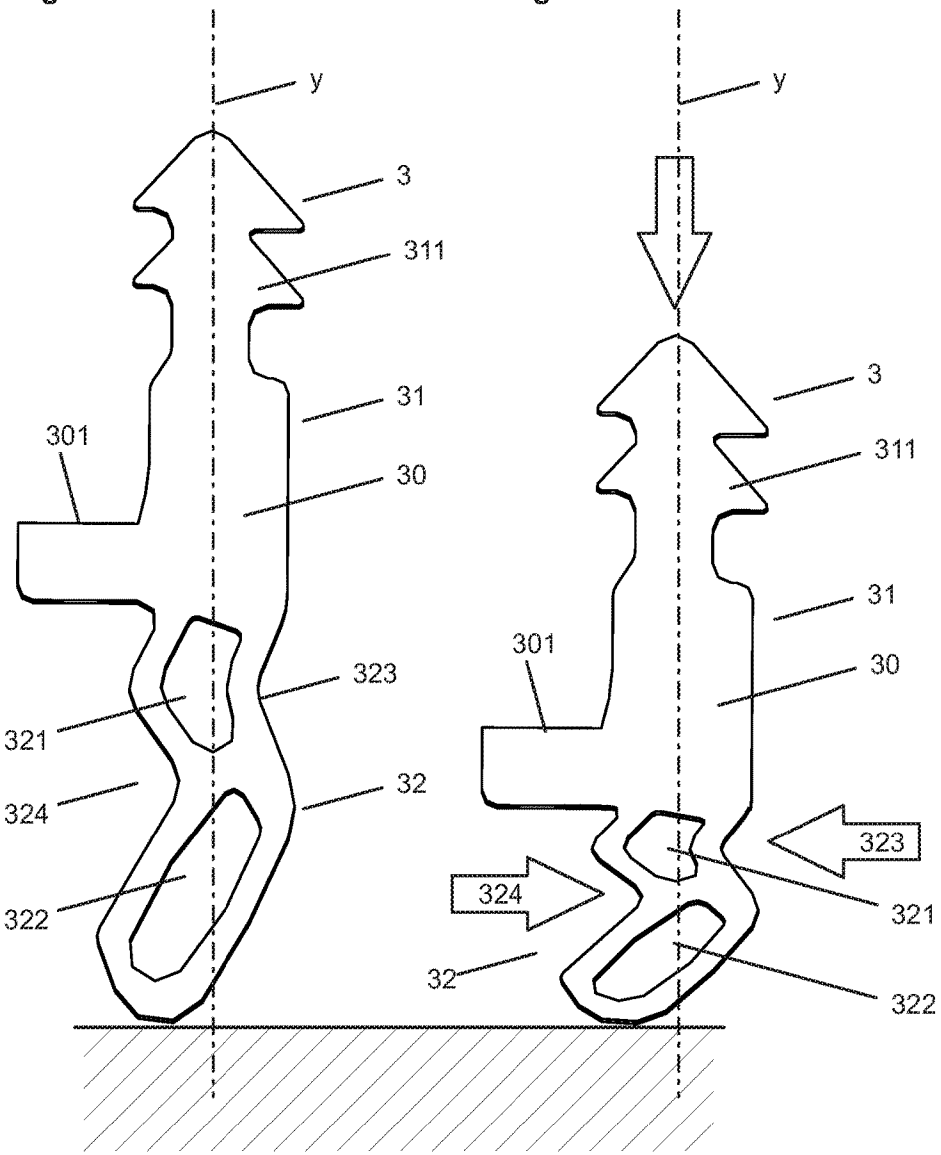
Fig. 6c
Fig. 6b
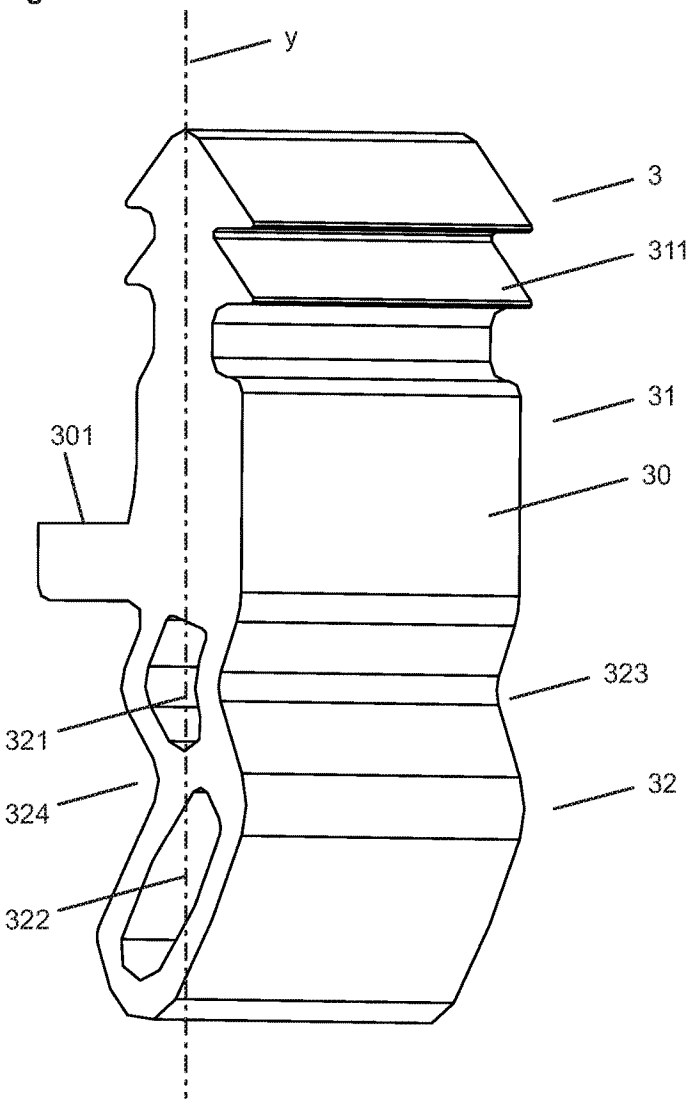
Fig. 6a

SLIDING ELEMENT WITH SEALING DEVICE AND SEALING ELEMENT

TECHNICAL FIELD

The invention relates to a sliding element, particularly a sliding door, that is displaceable along a rail and that is provided with a sealing device, with which a room opening is closable. The invention relates further to a sealing element for such a sealing device.

BACKGROUND OF THE INVENTION

For separating or partitioning rooms or for closing room openings or window openings often sliding elements are used, such as sliding doors made of glass or wood, which are typically guided along a rail by means of two carriages. U.S. Pat. No. 9,290,977B2 discloses a device with carriages that are movable along rails. The device allows moving a sliding element in front of a room opening and finally against the room opening in order to close it tightly. Between the sliding door and the edge of the room opening, e.g. a door frame or a casing, a sealing is provided, which is compressed by a desired degree as soon as the sliding door is guided against the room opening. In order to avoid an optical appearance of the sealing, the sealing is not placed at the front side, but at the rear side of the sliding door.

The sealing device disclosed in U.S. Pat. No. 9,290,977B2, which is shown below in FIG. 2, comprises a multi-part mounting strip 6 to which a circumferential sealing element 5 is connected. Different elements of the mounting strip 6, straight elements and corner elements are connected to the rear side of the sliding element in such a way, that a peripheral frame is formed, which runs close to the edge of the rear side of the sliding element. The mounting strip 6, i.e. its elements are provided with an anchor channel 60, in which an anchor member of the sealing element 5 can be anchored to secure the sealing element 5. The anchor member 51 is provided with a compression element 52, which has two chambers 521, 522. The first chamber 521 is laterally outwardly directed and the second chamber 522 is directed downwardly. When contacting edges of the room opening the first chamber 521 is compressed. When lowering the sliding door the second chamber 522 is guided against the floor and compressed.

Hence, for mounting the sealing device a relatively large effort is required, because first the mounting strip 6 needs to be screwed precisely aligned to the sliding element 1' and only then the sealing element 5 can be inserted. The sealing element 5 exhibits relatively large dimensions. The material expenditure and installation effort is therefore considerable. The combination of the mounting strip 6 and the damping element 5 also requires a large space, wherefore the sliding element 1' cannot be guided as close to the room opening as desired. The sliding element 1' driven in front of the room opening looks visually voluminous. In spite of the relatively large dimensions the sealing element 5 exhibits only small compression paths, wherefore correspondingly small and precise displacements of the sliding door or larger dimensions of the damping elements 52 need to be provided.

US2012260579A1 discloses a seal with a conventional T-shaped anchor member and a compression member, which comprises a circular cross-section and two chambers. The T-shaped anchor member requires a T-shaped anchor groove in a door panel into which the anchor member can be inserted only after considerable deformation. The anchor member sits therefore possibly with considerable play in the anchor groove and is exposed to significant wear. The compression body with the circular cross-section has only a relatively small compression path and can therefore seal only relatively small air gaps.

DE4228986A1 discloses a seal for a door or window with an arrow-shaped anchor member which is engaged in a T-shaped anchor groove that is opened towards the front side of the door. This seal cannot advantageously be anchored particularly at the edge of the sliding door.

EP1431501A2 discloses a sliding door system with a sliding door held in a guiding device and a sealing device with sealing profiles that directly contact the floor or directly contact one another, resulting in a disturbing friction which is reduced by appropriate choice of material.

SUMMARY OF THE INVENTION

The present invention is therefore based on the object of providing an improved sliding element with a sealing device as well as an improved sealing element.

The sealing device shall have a simple construction and shall be mountable with little effort. The sealing device shall require as little material as possible and shall be producible at low-cost. Further, the sealing device shall allow the sliding element, i.e. the sliding door, to be driven close to the room opening, i.e. the door frame or casing provided there. It shall be possible to manufacture the sliding element with the sealing device with slim dimensions, so that an aesthetically advantageous impression results. The sealing element shall effortlessly be mountable and shall in spite of the relatively small dimensions have a relatively large compression path and shall tightly seal the gap between the sliding element and the door frame or casing.

This problem is solved with a sliding element with a sealing device according to claim 1 as well as a sealing element according to claim 11. Preferred embodiments of the invention are defined in further claims.

The sliding element comprises a sliding plate and a sealing device that comprises at least one sealing element, which forms a sealing frame that is arranged on a rear side of the sliding plate and that extends peripherally along an edge of the sliding plate.

According to the invention the sliding plate comprises a base plate and a flange plate, which is offset from the base plate, which is connected in one piece to the base plate and which is separated at its edge from the base plate by a circumferential anchor groove, which anchor groove serves for holding the at least one sealing element, which at least one sealing element comprises an anchor member that is inserted into the anchor groove and that is connected via a connection body to a compression member. Further, the anchor member of the at least one sealing element held within the anchor groove is aligned at least approximately in parallel to the sliding plate, i.e. to the front side or rear side of the sliding plate.

With the inventive solution, the requirement of a mounting strip, which is provided with an anchor groove, can be avoided. The anchor groove is advantageously incorporated into the sliding plate, whereby, on the one hand, the base plate, which is visible from the front side of the room opening and, on the other hand, the flange plate, which is visible from the rear side of the room opening, enclose the anchor groove. The base plate and the flange plate have outer surfaces facing in opposite directions, which preferably are identical in design and are indistinguishable by the user. Laterally and on the upper side, the dimensions of the base plate are preferably slightly larger than the dimensions of the flange plate, so that a receiving space for the connection body of the related sealing element is provided, which is displaced to the back relative to the flange plate and is supported by the base plate. Hence, the related sealing element is not only anchored in the sliding plate, but is also integrated therein, wherefore only device parts which are relevant for the sealing function, protrude from the sliding plate. At the lower side however, the flange plate can project beyond and cover the base plate and serve for covering sealing elements provided there.

Hence, the at least one sealing element can quickly and conveniently be mounted in the anchor groove and fulfils the sealing function optimally, while it does not appear optically. Due to the avoidance of a mounting strip the sliding plate with the sealing device integrated therein can be made slim and aesthetically advantageous. The room opening can tightly be closed by means of the inventive sliding element, i.e. the inventive sliding door. Due to the omission of the mounting strip and the integration of the sealing elements into the sliding plate, the slim sliding plate can be driven close against the room opening and requires little space only in front of the tightly sealed room opening.

Since the sliding plate with the anchor groove can be manufactured with machines and the sealing element can quickly be inserted into the anchor groove, e.g. also at the place of installation, the inventive sliding element can be manufactured inexpensively with minimal effort and material costs.

The sealing elements, i.e. sealing profiles, can be made from conventional materials such as rubber or silicone. Thereby, on the one hand for the anchor member and on the other hand for the compression member different materials can be used whose properties are adapted to the function of the anchor member or the compression member respectively. The anchor member can be manufactured for example from a less elastic material than the compression member.

In a preferred embodiment, a first sealing element with its anchor member is anchored in a upper member of the anchor groove at the upper side of the sliding plate and in a left and a right member of the anchor groove on the left and the right side of the sliding plate and a second sealing element with its anchor member is anchored in a lower member of the anchor groove at the lower side of the sliding plate. With two different sealing elements the assigned tasks can optimally be fulfilled with minimum material requirement. By the first sealing element a lateral coupling to a plane, which is defined by the edge of the room opening or the casing mounted there. I.e., the sliding plate can be moved in front of the room opening and then can be driven against the room opening, whereby the room opening, laterally and at the upper side, is tightly closed by means of the first sealing element. The second sealing element serves for closing a gap which remains after the sliding plate has been lowered to the floor.

A stable connection between the sliding plate and the first sealing element and, at the same time, a space saving partial integration of the first sealing element into the sliding plate is achieved because the anchor member of the first sealing element is held within the anchor groove aligned at least approximately in parallel to the sliding plate. Optimum sealing however results by the alignment of the compression member of the first sealing element with a first compression axis perpendicular to the sliding plate.

A particularly reliable sealing is achieved, by forming the compression member of the first sealing element at least approximately symmetrical and with a form of a cardioid having two contact zones and a symmetry axis, which corresponds to the first compression axis. With the embodiment at least approximately in the form a cardioid, two contact zones result after closing the sliding door, which practically effect a doubled sealing.

As mentioned, in preferred embodiments the first sealing element can exclusively be used for creating the sealing frame. I.e., the first sealing element can also be provided at the lower side the sliding plate.

In a further preferred embodiment, a second sealing element is provided, whose anchor member, within the anchor groove, is at least approximately aligned in parallel to the sliding plate, and whose compression member has a second compression axis, which extends in parallel to the sliding plate. Hence, the circumferential anchor groove is also aligned in parallel to the base plate and to the flange plate.

The second sealing element can be designed particularly slender, by providing that the second compression axis, which after mounting the second sealing element is vertically aligned, traverses the anchor member and the compression member of the second sealing element.

Preferably the compression member of the second sealing element comprises at least on one side or on both sides each at least one bending fold, which are aligned inclined, preferably perpendicular to the second compression axis. If a plurality of bending folds is provided, then they are arranged alternately on both sides of the compression member and mutually displaced along the second compression axis.

The bending folds are designed and arranged in such a way that, when the second sealing element is displaced along the second compression axis, the compression member of the second sealing element is compressed, whereby the compression chambers move essentially along the second compression axis and are not laterally swivelled out. By the inventive embodiment of the second sealing element is therefore provided that its compression member is compressed along the second compression axis. Hence, after closing the sliding door a broad sealing body results at its lower side, which tightly closes the related door gap. Lateral tilting of the compression member, which would inhibit a desired compression, is avoided. By the compression of the compression member along the second compression axis a relatively broad door gap can reliably be sealed without requiring larger dimensions of the sealing element. Hence, in spite of the slender design of the second sealing element, the sealing function is still optimally fulfilled.

In preferred embodiments, the compression member of the second sealing element comprises at least two compression chambers, which are arranged upon one another along the second compression axis and which move essentially along the second compression axis when the second sealing element is lowered to the floor. By the compression chambers, which comprise hollow spaces, a perfect acoustic and thermal sealing is reached.

The bending fold, i.e. at least one of the bending folds, is preferably arranged along the second compression axis between the compression chambers. Bending folds can also be incorporated in the walls of the compression chambers to facilitate the compressions process, optionally in combination with a folding process. The at least one bending fold can be provided in the form a curvature, groove or material recess.

The sealing frame can also be formed completely by the second sealing element. I.e., the second sealing element can also be inserted into the anchor groove laterally and on top of the sliding plate.

Hence, for forming the sealing frame the first sealing element or the second sealing element or combinations of the first and second sealing element may advantageously be used. In all possible alternative embodiments the compression axis of the compression member is preferably always aligned perpendicular to the body, i.e. to the body surface that needs to be sealed.

The compression axis of the compression members of the first sealing element and of the second sealing element can be aligned in parallel or inclined, preferably perpendicular to the axis of the anchor member of the related sealing element. Hence, the first and second sealing elements can universally be used individually or in combination and in different embodiments for forming a sealing frame.

BRIEF DESCRIPTION OF THE DRAWINGS

The invention is described below in detail with reference to the drawings, wherein:

FIG. 6*a* shows in spatial view a section of the unstressed second sealing element 3 with the anchor member 31 and the compression member 32, which are connected with one another by a connection body 30;

FIG. 6*b* shows the unstressed second sealing element 3 of FIG. 6*a* from the front side;

FIG. 6*c* shows the stressed second sealing element 3 of FIG. 6*b* with the anchor member 31 displaced downwards and the compressed compression member 32;

DETAILED DESCRIPTION

Figure 1B:
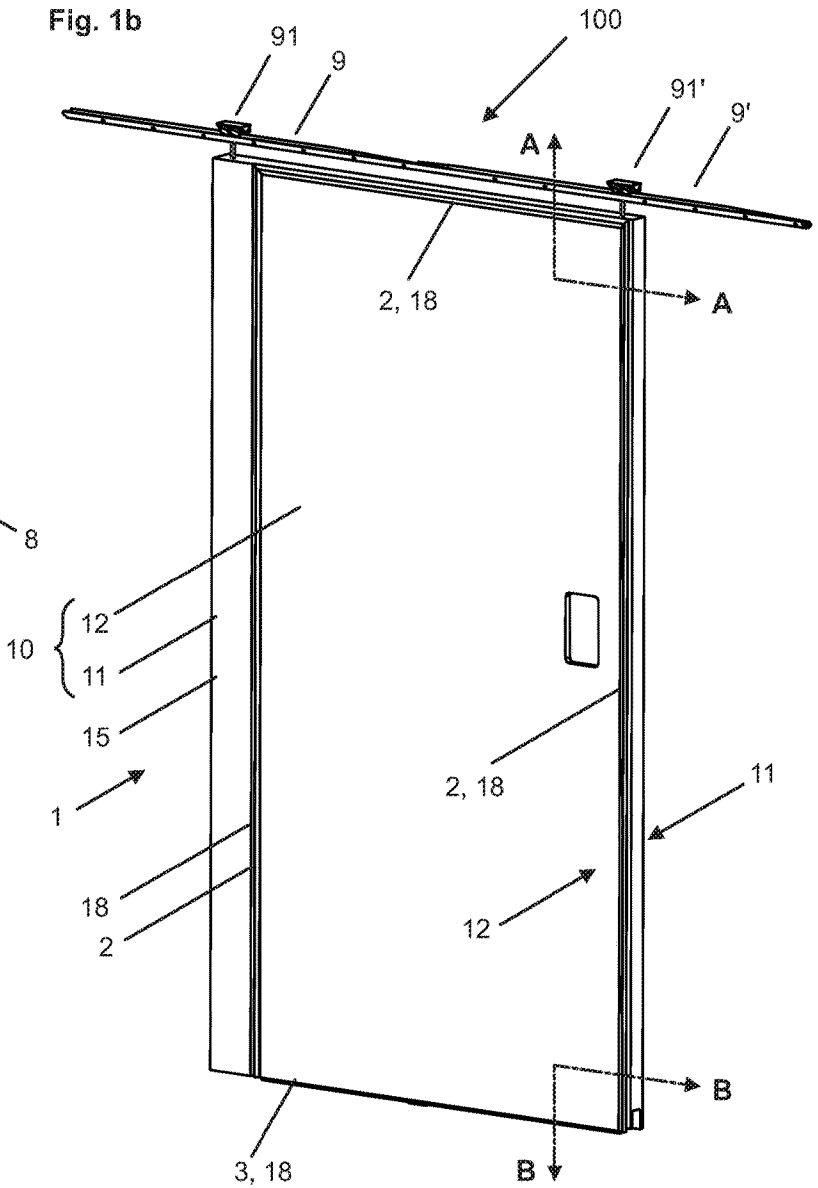
FIG. 1*b* shows the sliding door 1 of FIG. 1*a*, which by means of carriages 91, 91' is guided along rails 9, 9', without the cover 99 of the rail 9 and without a door frame or casing 8.
Figure 1A:
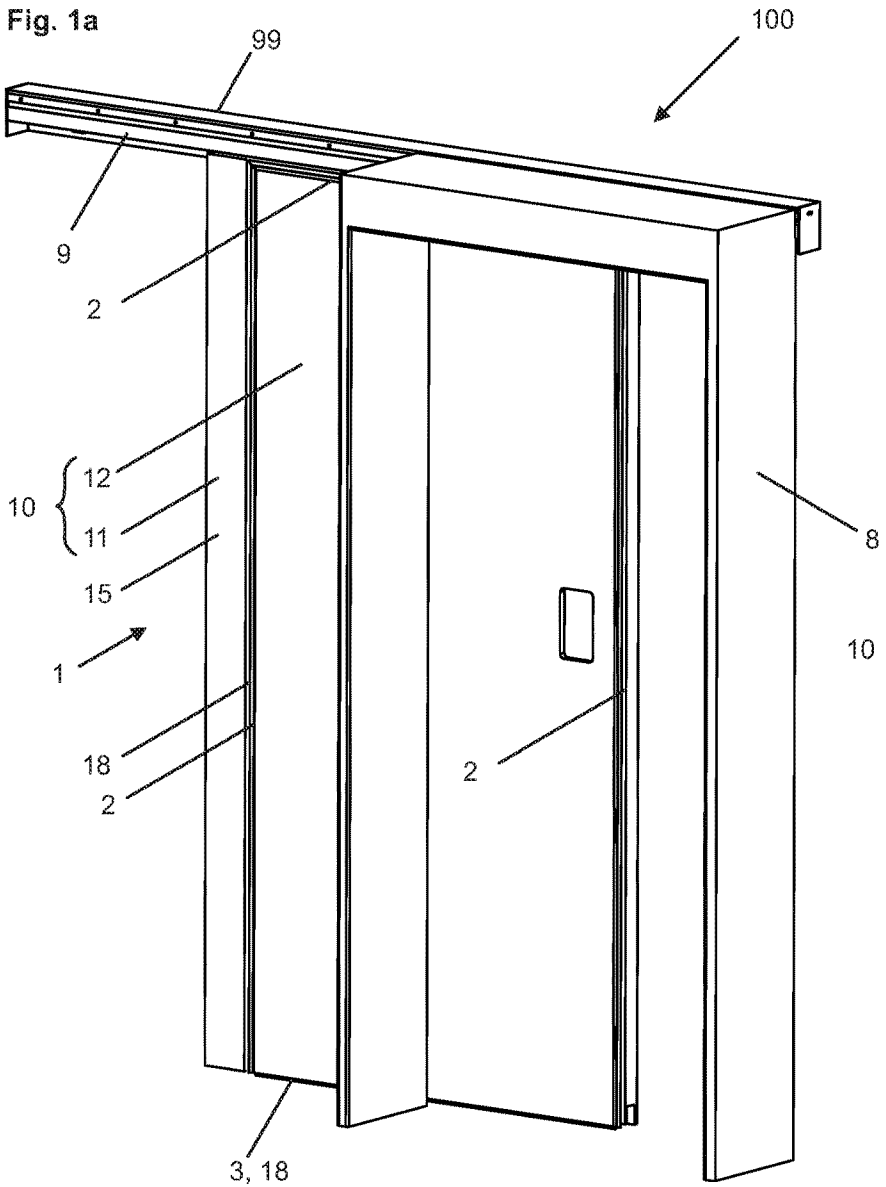
FIG. 1*a* shows a sliding system 100 with a sliding element, i.e. a sliding door 1, that is provided with a sliding plate 10 and a sealing device with a sealing frame, which comprises a first sealing element 2 that runs along the upper side and along the lateral edges of the sliding plate 10, and a second sealing element 3 that runs along the lower side of the sliding plate 10.

FIG. 1*a* shows an inventive sliding system 100 with an inventive sliding element, i.e. a sliding door 1, which in this preferred embodiment is displaceable along two rails 9 in front of a room opening, i.e. a door frame or casing 8. The rails 9 are covered by a bezel 99. As an alternative only one rail can be used as well.

In preferred embodiments the sliding system 100 is designed in such a way that the sliding door 1 can be moved horizontally in front of the room opening and in the final phase of the closing process can be moved against the casing 8 and against the floor, in order to tightly close the room opening on all sides.

For this purpose, the sliding door 1 comprises a sliding plate for example made from wood, that in this preferred embodiment is provided with a sealing device, which comprises a first sealing element 2 arranged along the upper edge and along the lateral edges of the sliding plate 10, and a second sealing element 3 arranged along the lower side of the sliding plate 10. Hence, both sealing elements 2, 3 form a sealing frame at the rear side of the sliding door, which is partly or preferably fully closed in itself. When closing the sliding door 1, the first sealing element 2 is guided against the casing 8 and the second sealing element 3 is guided against the floor and compressed, thereby providing optimal acoustic and thermal sealing.

The sliding plate 10 comprises on the front side a base plate 11 and on the rear side a flange plate 12 that is facing the door frame or casing 8. Between the base plate 11 and the flange plate 12 an anchor groove 18 is provided, which surrounds the flange plate 12 like a frame and in which the sealing frame with the first and second sealing element 2, 3 has been inserted.

At the left side and outside of the sealing element 2 the sliding plate 10 is optionally provided with an edge member 15, which is connected to a first carriage 91. At the front side the sliding plate 10 is connected to a second carriage 91'. As described in U.S. Pat. No. 9,290,977B2 the two carriages 91, 91' are preferably guided on separate rails 9, 9'. Along the second rail 9', the front-sided second carriage 91' can completely be driven away from the room opening. In order to avoid that the first carriage 91 enters the range of the second rail 9', it is displaced relative to the range of the sliding door 1, which together with the sealing device is used for sealing the room opening. In the shown embodiment, this is reached particularly advantageous by the asymmetrical design of the sliding door 1 which in addition is provided with the edge member 15. Hence, the carriages 91, 91' can advantageously be decoupled from the neighbouring rails 9', 9 and the room opening can completely be opened.

Figure 3A:
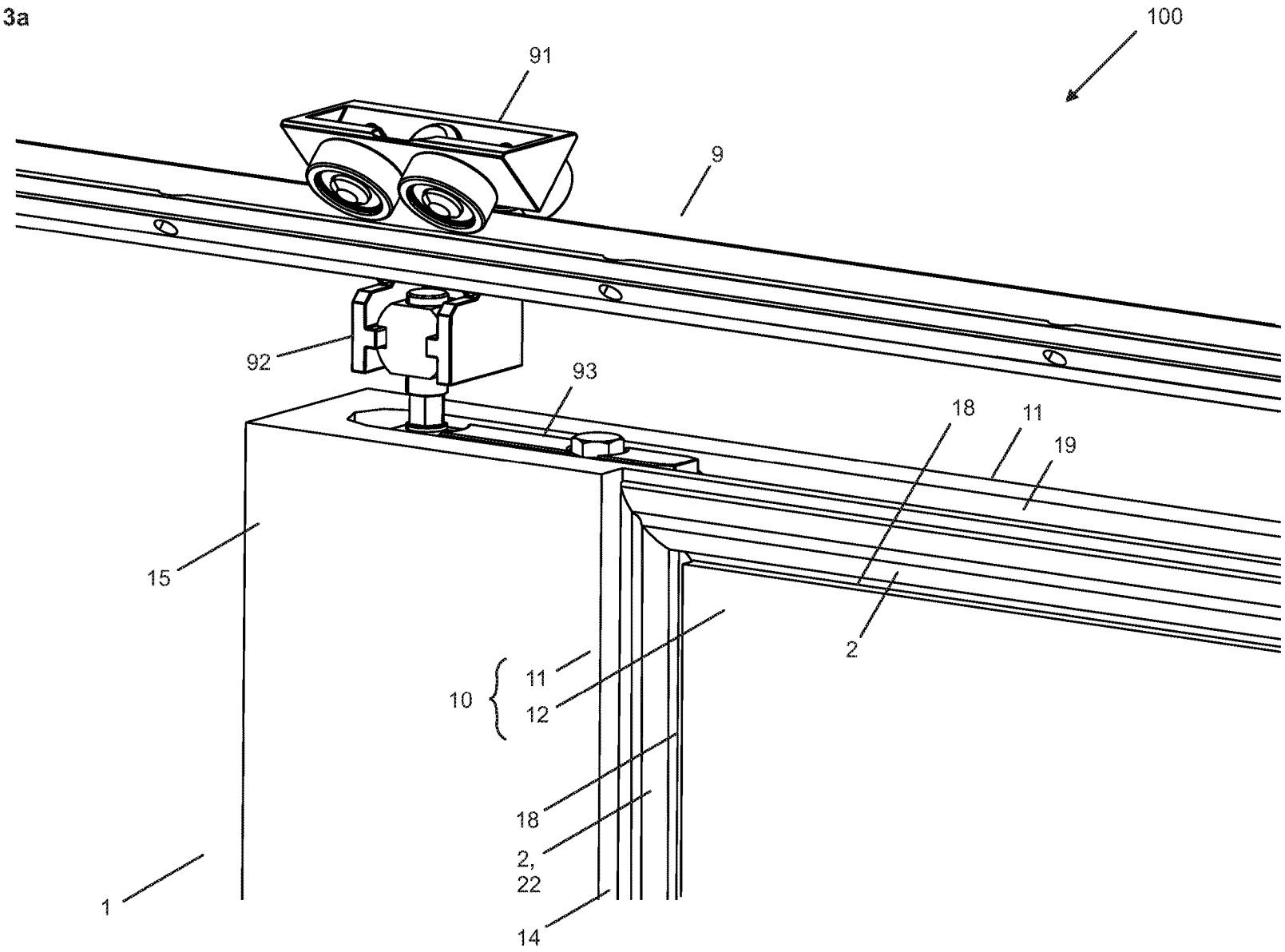
FIG. 3*a* shows the left upper corner of the asymmetrically designed sliding plate 10 of FIG. 1*b*, which comprises a flange plate 12 that serves for holding the sealing frame 2, 3 and an edge member 15, which is provided at the left side of the sealing elements 2 and which is connected by means of a connection device 92 to a first carriage 91.
Figure 3B:
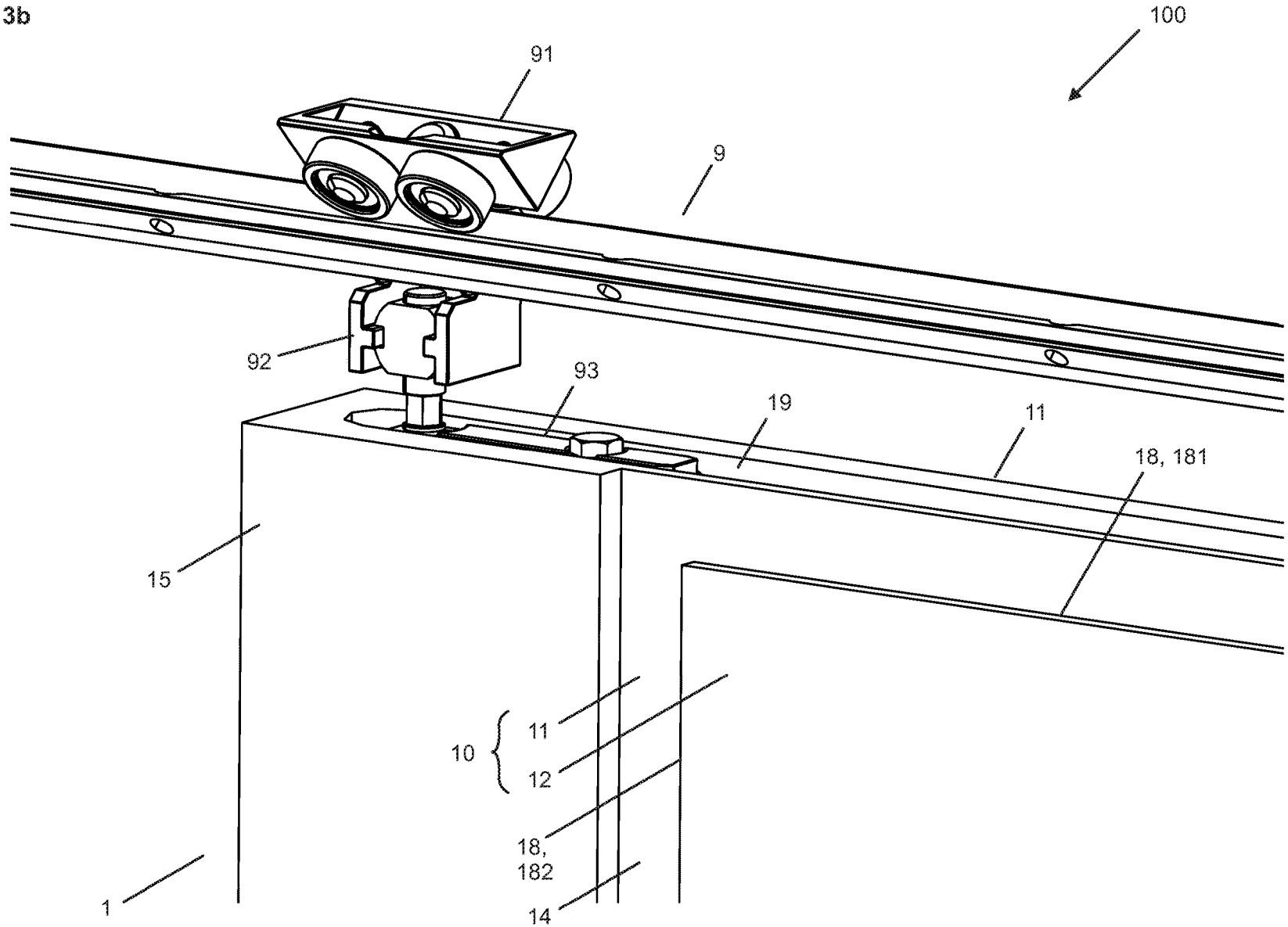
FIG. 3*b* shows the left upper corner of the asymmetrical formed sliding element 1 of FIG. 3*a* before mounting the sealing frame 2, 3.
Figure 3C:
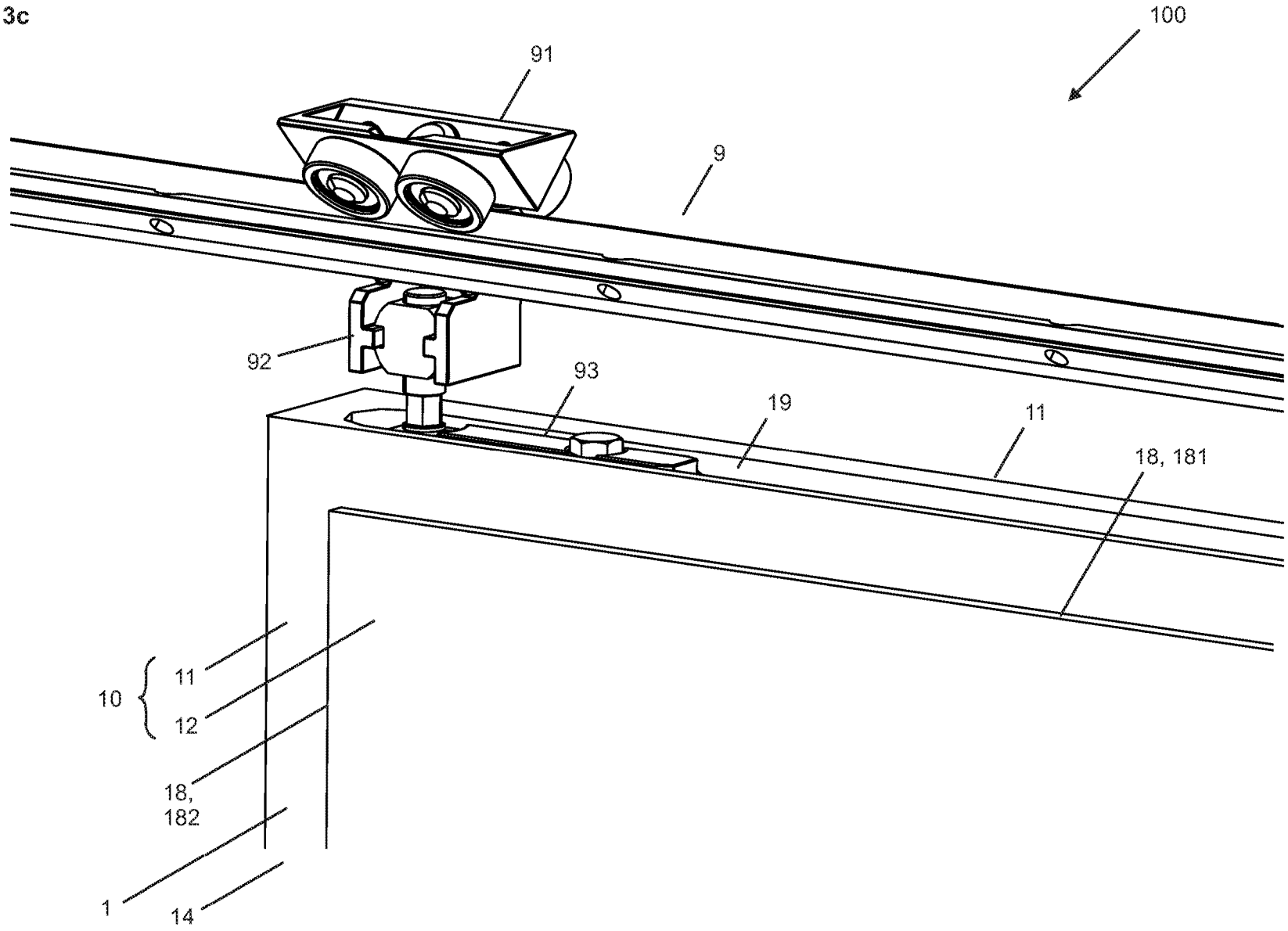
FIG. 3*c* shows the left upper corner of an alternative embodiment of the formed sliding element 1 of FIG. 3*a* before mounting the sealing frame 2, 3 that is similar to the embodiment shown in FIG. 3*b* but does not have the optional edge member 15.

The edge member 15 is therefore only optionally provided and, as shown in FIG. 3*c*, can also be omitted. Without this edge member 15 the left side of the sliding plate 10 would be identical to the right side and would identically be provided with the elements of the sealing frame 2; 3. Hence, the sliding element 1 can have a symmetrical or asymmetrical design.

FIG. 1*b* (see also FIG. 3*a*) shows, that the sliding door 1 is very slim even with the mounted sealing device. Essentially, only the parts of the sealing elements 2, 3, which are required for sealing purposes, are visible. The further parts of the sealing elements 2, 3 are integrated into the sliding door 1.

Figure 2:
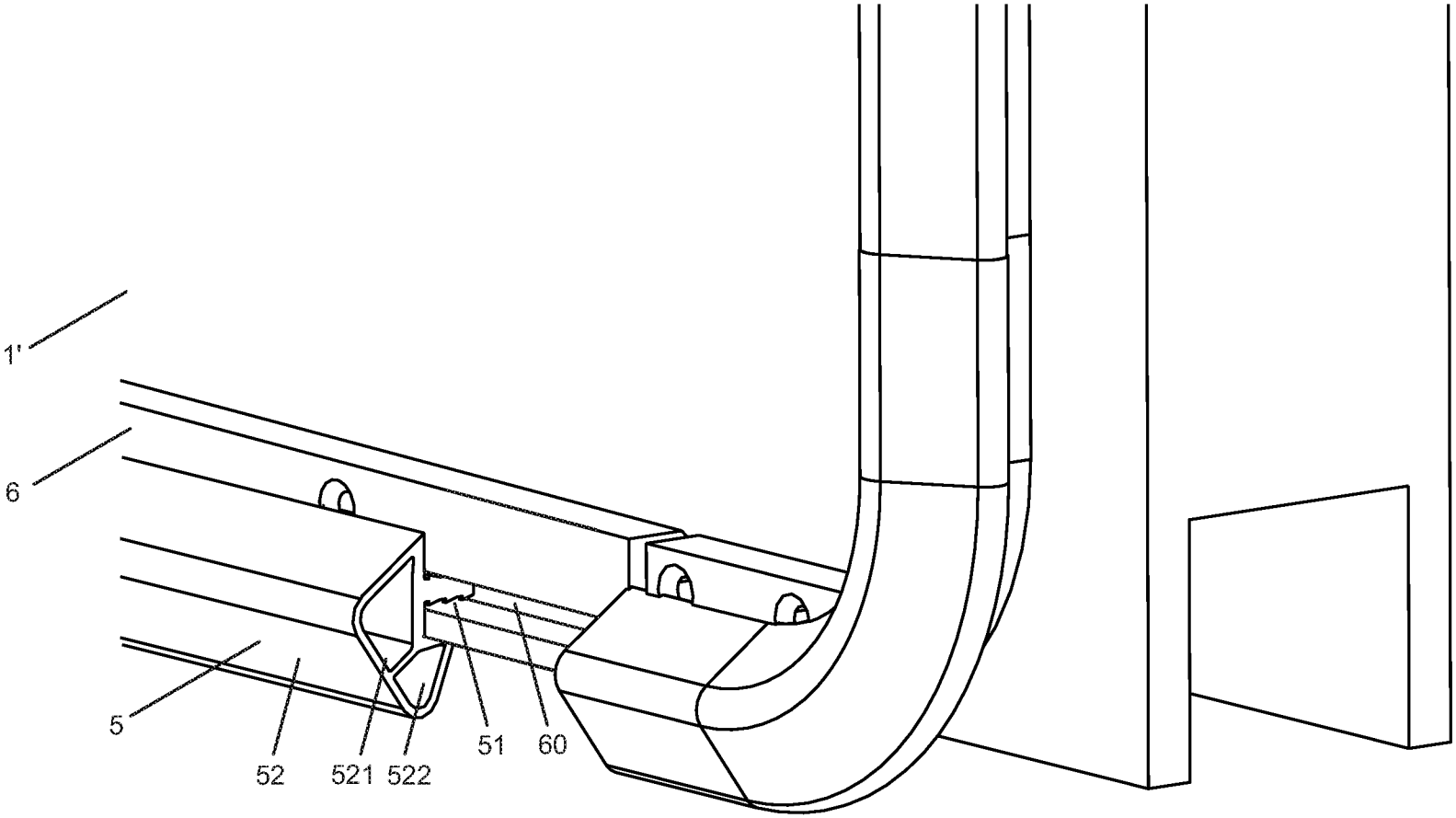
PRIOR ART Fig. 2
FIG. 2 shows the sliding door 1' disclosed in U.S. Pat. No. 9,290,977B2, which is provided with a sealing device, which comprises mounting strips 6, that are screwed to the sliding door 1', and a circumferential sealing element 5 or a looped sealing frame.

FIG. 2 shows the sliding door 1' disclosed in U.S. Pat. No. 9,290,977B2, which is provided with a sealing device, that comprises mounting strips 6 screwed to the sliding door 1' and a circumferential sealing element 5. The sealing element 5 comprises an anchor member 51 and a compression member 52 with two compression chambers 521, 522. The anchor member 51 is held in an anchor channel 60 provided in the mounting strip 6.

FIG. 3*a* shows the left upper corner of the asymmetrical designed sliding plate 10 of FIG. 1*b*, which comprises at the left side besides the first sealing element 2 the extended edge member 15, which is connected by a connection device 92 to the first carriage 91. For this purpose, a mounting device has been inserted into a mounting channel 19, which is provided at the upper side of the sliding plate 10.

Figure 4B:
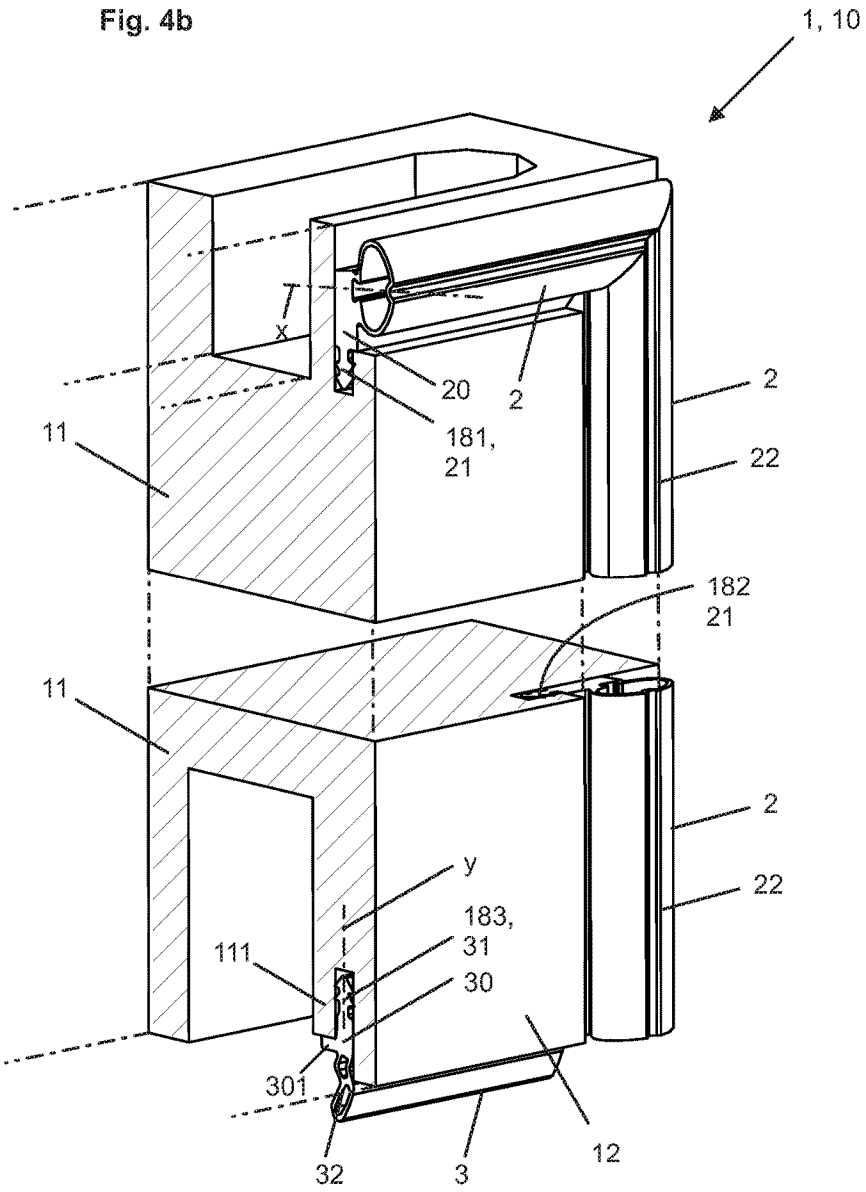
FIG. 4*b* shows the corner pieces of the right edges of the sliding plate 10 of FIG. 4*a* with the protruding flange plate 12, which holds the sealing frame 2, 3.

The sealing element 2 shown forms a member of the sealing frame shown in FIG. 1*b*, which is provided at the rear side of the sliding plate 10. The sealing frame comprises, as shown in FIG. 1*b* and FIG. 4*b*, the first sealing element 2, which forms the upper part and the lateral parts of the sealing frame, as well as the second sealing element 3, which forms the lower member of the sealing frame. The form of the sealing frame is preferably adapted to the form of the sliding plate 10 and/or the form of the edges of the room opening, i.e. the door frame or casing 8 provided there.

FIG. 4*b* shows further, that the first and the second sealing elements 2, 3 comprise each an anchor member 21; 31 and a compression member 22; 32, which are connected with one another by a connection body 20; 30.

The first sealing element 2 shown in FIG. 3*a* is almost completely integrated into the sliding door 1. The anchor member 21 is received in an anchor groove 18. The connection body 20 is received in a receiving space 14 that adjoins the anchor groove 18. The compression member 22 protrudes however out of the receiving space 14, preferably at least to an extent, as it shall be compressed to obtain a tight closing. Hence, FIG. 3*a* shows that the sliding door 1 can be designed with minimal dimensions and the sealing device can aesthetically advantageously be integrated into the sliding plate 10.

For the purpose of advantageously mounting the sealing frame with the sealing elements 2, 3, a circumferential anchor groove 18 is introduced at the rear side of the sliding plate 10. The anchor groove 18 forms an anchor frame, which corresponds to the sealing frame with the sealing elements 2, 3. The sliding plate 10 comprises a base plate 11 at the front side and a flange plate 12 at the rear side facing the room opening, which is connected in one piece with the base plate and which is merely peripherally separated from the base plate 11 by the anchor groove 18 and the receiving space 14.

By introducing the receiving space 14 and the anchor groove 18 the flange plate 12 is excavated at the edges. For example, in a first process the receiving space 14 and in a second process step the anchor groove 18 is excavated, which is directed between the base plate 11 and the flange plate 12 in parallel thereto against the neighbouring side of the sliding door 1. Hence, the profile of the excavated recess with the receiving space 14 and the anchor groove 18 is preferably an L-profile that is directed towards the centre of the flange plate 12. Since the sliding plate 10 with the base plate 11 and the flange plate 12 is preferably made as one unitary piece, the front side and the rear side of the sliding door 1 have an identical appearance, if the user does not prefer another design. After the sliding door 1 has been closed, the sealing frame 2, 3 adjoins the casing 8 and the floor and is therefore invisible. At the front side and the rear side for example only a white surface or the wooden structure of the sliding plate 10 is visible.

The sliding plate 10 can be made from metal or plastic. If the sliding plate 10 is made from plastic, a casting box, whose interior space corresponds to the dimensions the sliding plate, may for example be provided and filling material with an L-profile is positioned at locations, where the receiving space 14 and the anchor groove 18 are provided. Subsequently plastic is poured into the casting box.

Since in the receiving space 14 receives at least a part of the sealing frame 2, 3, the dimensions of the flange plate 12 will typically by a degree, which corresponds to the dimensions of the sealing frame 2, 3, be smaller than the dimensions of the base plate 11.

FIG. 3*b* shows the left upper corner of the asymmetrical designed sliding plate 10 of FIG. 3*a* before insertion of the sealing frame, i.e. of the first sealing element 2. It is shown, that the flange plate 12 is peripherally separated from the base plate 11 by the receiving space 14 and the anchor groove 18, which extend in the shape of a frame. Hence, at the rear side of the sliding plate 10, the flange plate 12 is offset from the base plate 11. The flange plate 12 and the edge member 15 of the sliding plate 10 preferably form a planar surface. Hence, FIG. 3*b* shows that not only the mounting strip 6 of the known solution of FIG. 2 can be avoided to spare material labour and space, but that parts of the sealing frame 2, 3, which are not required for the sealing function, 3 can be sunk into the sliding plate 10 in order to save further space.

Figure 4A:
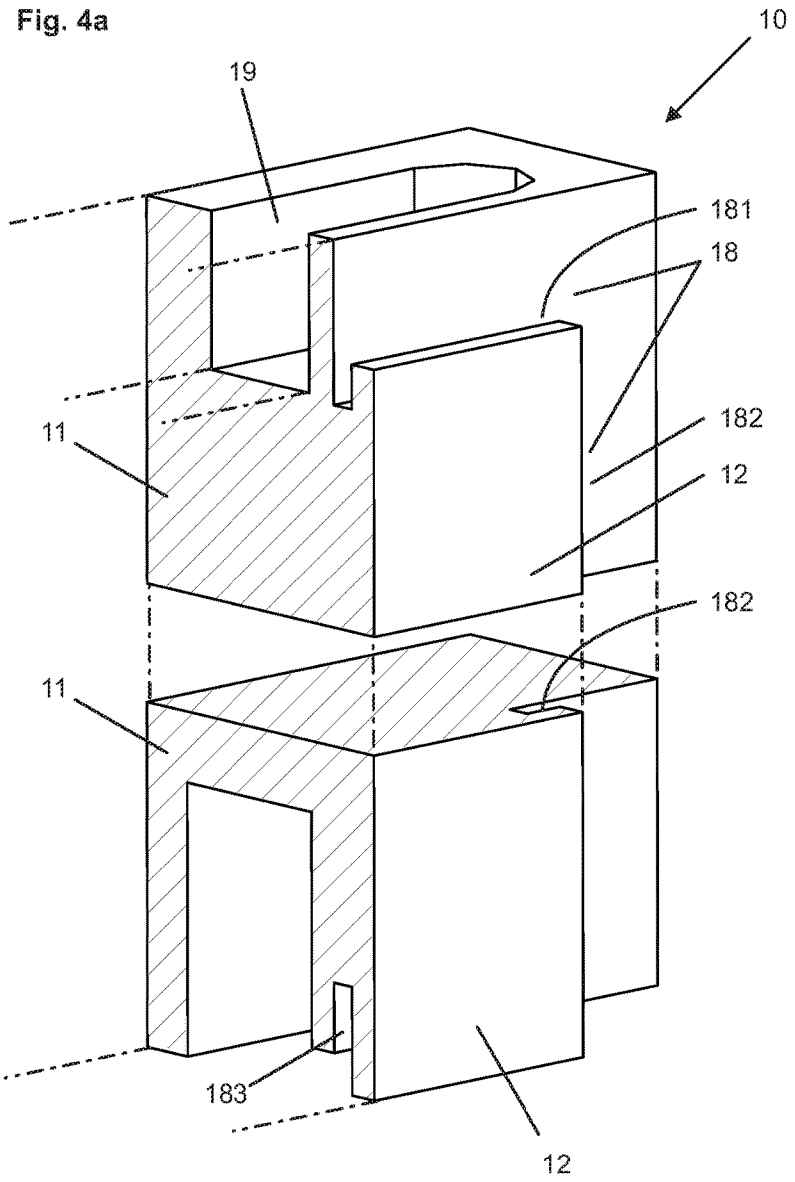
FIG. 4*a* shows corner pieces of the sliding plate 10 cut along the cutting lines A--A, B--B of FIG. 1*b* with the flange plate 12, which peripherally is separated from the base plate 11 by an anchor groove 18, which serves for mounting the sealing frame 2, 3.

FIG. 4*a* shows above the upper right corner piece of the sliding plate 10 cut along the cutting line A--A of FIG. 1*b* and below the lower right corner piece of the sliding plate 10 cut along the cutting line B--B of FIG. 1*b*. By auxiliary lines the cut-out intermediate piece between the two corner pieces as well as the cut-out left member of the sliding plate 10 is symbolised, which can be designed symmetrical or asymmetrical. It is shown that the flange plate 12 peripherally is separated by the anchor groove 18 from the base plate 11, but else is connected in one piece to the base plate 11. The anchor groove 18 comprises an upper anchor groove section 181 at the upper side, a lower anchor groove section 183 at the lower side and lateral anchor groove sections 182 at the right and left side of the flange plate 18 auf. Hence, the anchor groove 18 with the anchor groove sections 181, 182, 183 has the form of a frame and allows receiving the sealing frame 2, 3, which preferably forms a closed loop, which in the shown embodiment has a rectangular form, but can also incorporate curves and bows.

FIG. 4*b* shows the corner pieces of the right edge of the sliding plate 10 of FIG. 4*a* with the sealing frame inserted into the anchor groove 18. The sealing frame comprises in this preferred embodiment a first sealing element 2 and a second sealing element 3 which are differently designed and which fulfil different functions. The first sealing element 2 is inserted into the upper anchor groove section 181 and into the lateral anchor groove sections 182 and serves for sealing the sliding plate 10 against the casing 8 (see FIG. 1*a*). The second sealing element 3 is inserted into the lower anchor groove section 183 and serves for sealing the lowered sliding plate 10 against the floor.

As shown in FIGS. 4*b*, 5, 6*a*, 6*b* and 6*c*, the two sealing elements 2, 3 comprise each an anchor member 21; 31, which can be inserted into the anchor groove 18, and a compression member 22; 32, which are mutually connected by the connection body 20; 30.

Figure 5B:
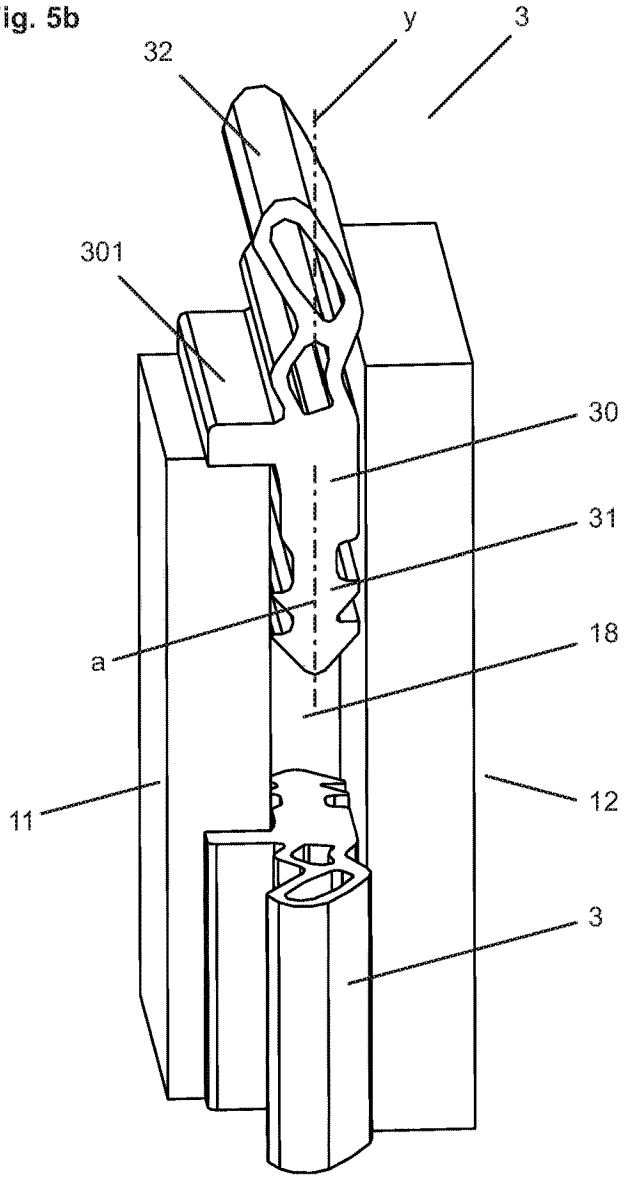
FIG. 5*b* shows the lower right corner piece the sliding plate 10 in a preferred embodiment with the second sealing element 3, which in this embodiment is used for all four members of the sealing frame.
Figure 5A:
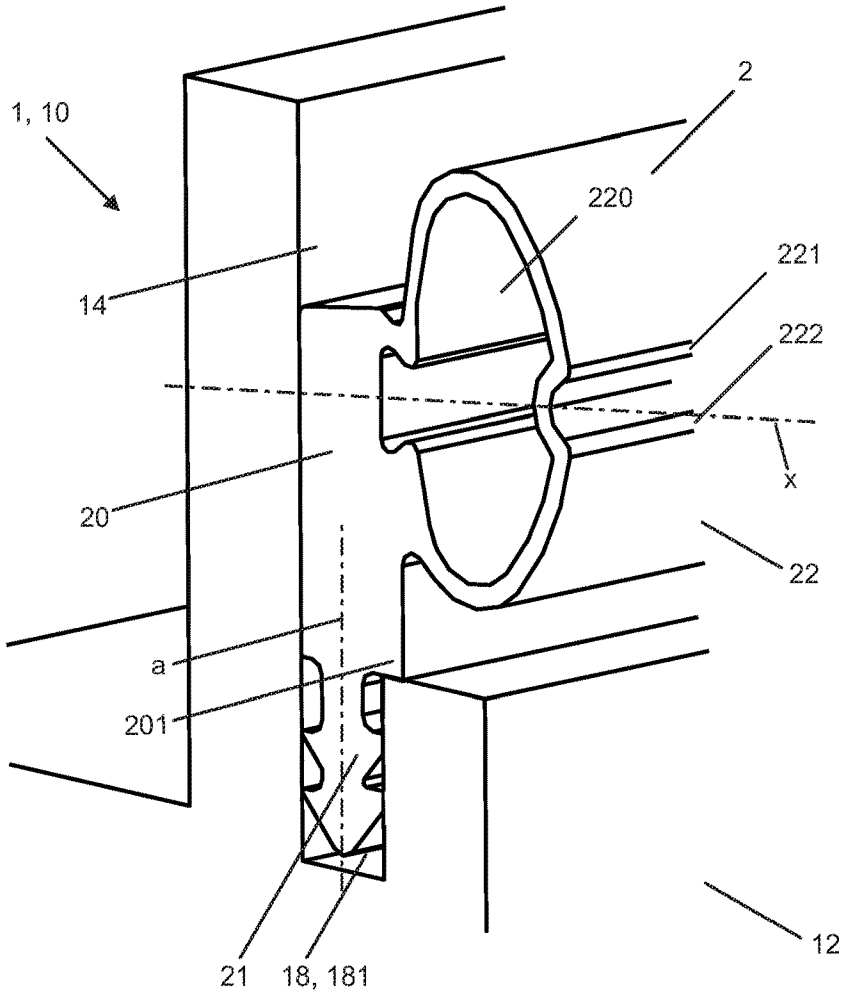
FIG. 5*a* shows the upper right corner piece of the sliding plate 10 of FIG. 4*b* with the mounted first sealing element 2.

FIG. 5*a* shows, that the anchor member 21 of the first sealing element 2, which has the profile of a tree, is held within the anchor groove 18 and is aligned at least approximately in parallel to the sliding plate 10 and that the compression member 22 of the first sealing element 2 has a first compression axis x, which is aligned perpendicular to the sliding plate 10. Hence, the anchor member 21 is securely held in the anchor groove 18, while the connection body 20 is received in the receiving space 14 and is supported by a part of the base plate 11. Adjacent to the anchor groove 18 the connection body 20 of the sealing element 2 is seated with a shoulder member 201 on the flange plate 12, which ensures even alignment of the first sealing element 2.

The compression member 22 of the first sealing element 2 is designed at least approximately symmetrical and has at least approximately the form of a cardioid that exhibits two contact zones 221, 222 and a symmetry axis, which corresponds to the compression axis x and which is aligned perpendicular to the room opening. When closing the sliding door 1 the two contact zones 221, 222 hit the casing 8, whereafter the compression member 22 is pressed against the base plate 11 and is deformed while maintaining symmetry. The two contact zones 221, 222 thereby effect a doubled sealing, wherefore reliable acoustic and thermal sealing results.

FIG. 4*b* shows, that the anchor member 31 of the second sealing element 3, which also exhibits the form of a tree and which essentially corresponds to the anchor member 21 of the first sealing element 2, is held within the anchor groove 18 and is aligned at least approximately in parallel to the sliding plate 10 and that the compression member 32 of the second sealing element 3 exhibits a second compression axis y, which is aligned at least approximately in parallel to the sliding plate 10 and after installation of the sliding door 1 perpendicular to the floor.

In this preferred embodiment the compression axis y traverses the anchor member 31 and the compression member 32 of the second sealing element 3 approximately in the middle. In this way only little space is required for mounting the second sealing element 3. The connection body 30 of the second sealing element 2 is seated with a shoulder member 301 on a shortened member 111 of the base plate 11 thereby ensuring that the mounted second sealing element 3 is aligned along a straight line. The flange plate 12 extends beyond the shortened member 111 of the base plate 11 and serves thereby as a bezel for covering the connection body 30.

It has been outlined that the sealing frame comprises the first sealing element 2, the second sealing element 3 or a combination therefrom. If the sealing frame consists only of the first sealing element 2, then it forms all four parts of the sealing frame as shown above in FIG. 4*b*. If the sealing frame however consists only of the second sealing element 3, then, as shown in FIG. 5*b*, it can be inserted from all sides into the anchor groove 18.

FIG. 5*b* shows as an example the lower right corner piece of the sliding plate 10 in a preferred embodiment with the second sealing element 3, which in this embodiment forms all four parts of the sealing frame. The longitudinal axis a of the anchor member 31 and the second compression axis y are coaxially aligned.

FIG. 6*a* shows in spatial view a section of the unstressed second sealing element 3 with the anchor member 31 and the compression member 32, which are mutually connected by the connection body 30. The anchor member 31, which adjoins the connection body 30 at the upper side and which is aligned along the compression axis y, shows the profile of a tree and is provided with two pairs of anchor elements 311. The connection body 30 is provided with the shoulder member 301, which serves as flange element. The compression element 32 comprises a smaller first compression chamber 321 and a larger second compression chamber 322, which are arranged along the compression axis Y one above the other. In the sidewalls of the first compression chamber 321 a first bending fold 323 is formed in. Between the two hollow compression chambers 321, 322 a second bending fold 324 is formed in. The first and the second bending fold 323, 324, i.e. the corresponding indentations are directed against one another and are formed at least approximately symmetrical to the compression axis y.

The bending folds 323, 324 and the compression chambers 321, 322 are formed in such a way, that when the second sealing element 3 is displaced along the second compression axis y, i.e. when vertically lowering the sliding plate 10, the compression member 32 of the second sealing element 3 is compressed and optionally partly folded. Thereby, the compression chambers 321, 322 are displaced downwards essentially along the second compression axis y. A lateral displacement of the compression element 22, by which the compression of the compression member 22 would fail, is avoided. Instead the compression chambers 321, 322 are compressed along the compression axis y, whereby a tight closure results below the sliding plate 10.

FIG. 6*b* shows the unstressed second sealing element 3 of FIG. 6*a* from the front side.

FIG. 6*c* shows the stressed second sealing element 3 of FIG. 6*b* with the anchor member 31 displaced downwards and the compression member 32 compressed along the compression axis y.

Figure 7B:
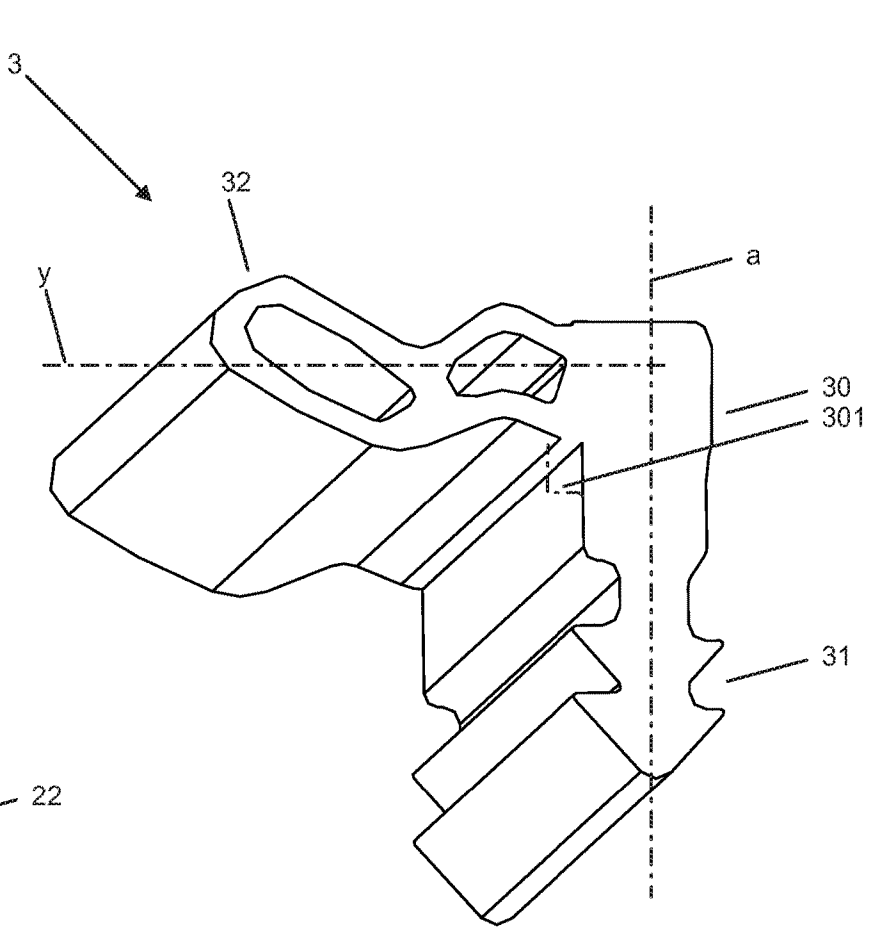
FIG. 7*b* shows the second sealing element 3 with the longitudinal axis a of the anchor member 31 and the compression axis y of the compression member 32 aligned perpendicular to one another.
Figure 7A:
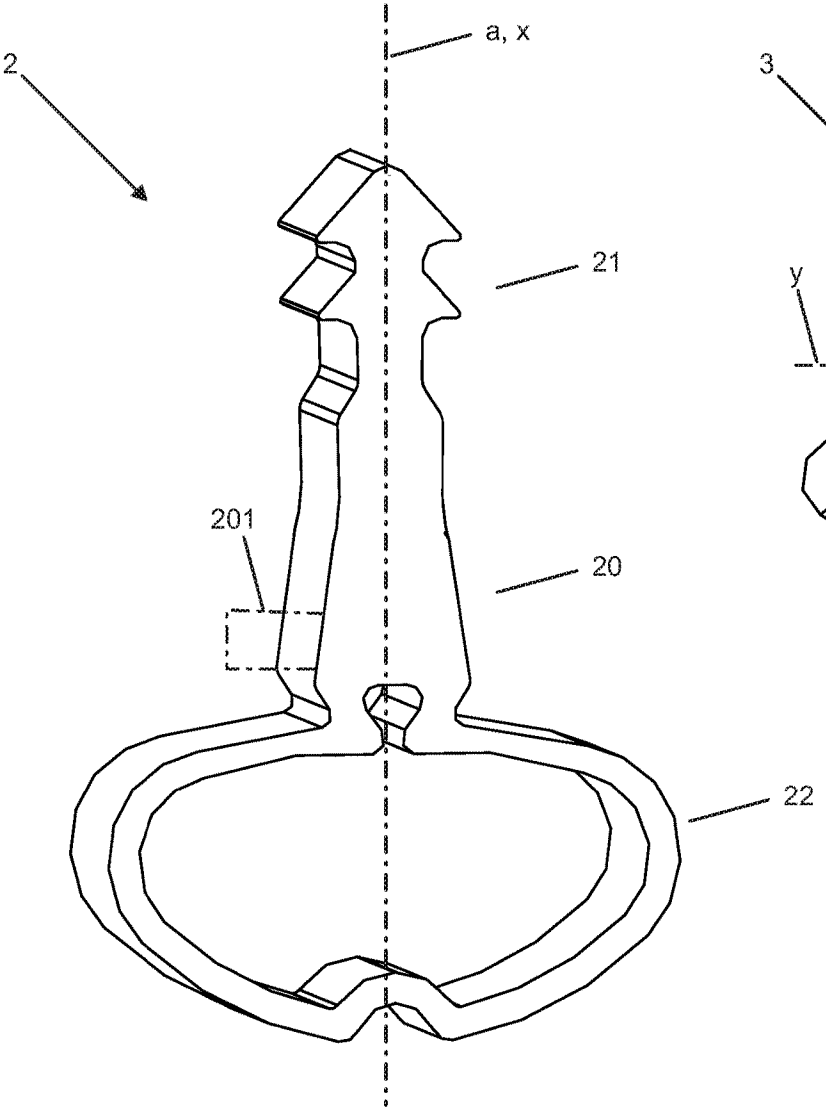
FIG. 7*a* shows the first sealing element 2 with the longitudinal axis a of the anchor member 21 and the compression axis x of the compression member 22 coaxially aligned.

FIG. 7*a* shows the first sealing element 2 with the longitudinal axis a of the anchor member 21 and the compression axis x of the compression member 22 coaxially aligned with one another. Hence, instead of the second sealing element 3 the first sealing element 2 can be inserted in the same way into the anchor groove 18 e.g. at the lower side of the sliding plate 10 of FIG. 4*b*. The shoulder member 201 drawn with a dashed line can optionally be provided.

FIG. 7*b* shows the second sealing element 3 with the longitudinal axis a of the anchor member 31 and the compression axis y of the compression member 32 aligned perpendicular to one another. Hence, instead of the first sealing element 2 the second sealing element 3 can be inserted in the same way into the anchor groove 18 e.g. at the upper side the sliding plate 10 of FIG. 4*b*. The shoulder member 301 drawn with a dashed line can optionally be provided as required.

LIST OF REFERENCES

100 sliding system
1 inventive sliding element, sliding door
1' known sliding element with sealing device

10 sliding plate
11 base plate
111 shortened member of the base plate 11
12 flange plate
14 receiving space
15 extended edge member
18 anchor groove
181 upper anchor groove section
182 lateral anchor groove sections
183 lower anchor groove section
19 mounting channel
2 first sealing element
20 connection body of the first sealing element
201 shoulder member of the connection body 20
21 anchor member of the first sealing element 2
22 compression member of the first sealing element 2
221 first contact wave
222 second contact wave
3 second sealing element
30 connection body of the second sealing element
301 shoulder member of the connection body 30
31 anchor member of the second sealing element 3
311 anchor elements
32 compression member of the second sealing element 3
321 first compression chamber
322 second compression chamber
323 first bending fold
324 second bending fold
5 known sealing element
51 anchor member of the known sealing element 5
52 compression member of the known sealing element 5
521 lateral compression chamber
522 lower compression chamber
6 mounting strip
60 anchor channel
8 door frame, casing
9 rails
91 carriages
92 connection device
93 mounting device
99 cover

The invention claimed is:

1. A sliding element comprising:

a sliding plate comprising a base plate and a flange plate offset from the base plate and connected in one piece to the base plate; and a sealing device comprising at least one sealing element, which forms a sealing frame that is arranged on a rear side of the sliding plate and that extends peripherally along an edge of the sliding plate, wherein:

an edge of the flange plate is separated from the base plate by a circumferential anchor groove configured to hold the at least one sealing element, the at least one sealing element comprises a compression member and an anchor member that is connected via a connection body to the compression member, the connection body and the anchor member being co-linear and the connection body being connected directly to the compression member, the anchor member of the at least one sealing element held within the anchor groove is aligned at least approximately in parallel to the sliding plate, the compression member of a first sealing element of the at least one sealing element has a first compression axis, which is aligned perpendicular to the rear side of the sliding plate and aligned perpendicular to a longitudinal axis of the anchor member, and the compression member of the first sealing element extends along the first compression axis beyond a rear side of the flange plate.

2. The sliding element according to claim 1, wherein:

the at least one sealing element includes the first sealing element and a second sealing element, the first sealing element is anchored with its anchor member (i) in an upper anchor groove section of the anchor groove at an upper side of the sliding plate, (ii) in a left anchor groove section at a left side of the sliding plate, and (iii) in a right anchor groove section of the anchor groove at a right side of the sliding plate, and the second sealing element is anchored with its anchor member in a lower anchor groove section of the anchor groove at a lower side of the sliding plate.

3. The sliding element according to claim 2, wherein the compression member of the first sealing element has a form, which is at least approximately symmetrical and which corresponds at least approximately to a form of a cardioid having two contact zones and a symmetry axis, which corresponds to the first compression axis.

4. The sliding element according to claim 2, wherein the anchor member of the second sealing element held within the anchor groove is aligned at least approximately in parallel to the sliding plate and the compression member of the second sealing element has a second compression axis, which is aligned in parallel to the sliding plate.

5. The sliding element according to claim 4, wherein the second compression axis, which, after mounting of the second sealing element, is vertically aligned, traverses the anchor member and the compression member of the second sealing element.

6. The sliding element according to claim 4, wherein the compression member of the second sealing element comprises one or two bending folds or a plurality of mutually displaced bending folds arranged alternately on both sides of the compression member of the second sealing element and aligned so as to be inclined, perpendicular to the second compression axis.

7. The sliding element according to claim 6, wherein the compression member of the second sealing element comprises at least two compression chambers, which are arranged along the second compression axis one upon the other.

8. The sliding element according to claim 7, wherein the bending fold or one of the bending folds is arranged along the second compression axis between the compression chambers.

9. The sliding element according to claim 7, wherein the bending fold or the bending folds and the compression chambers are designed such that, during a displacement of the second sealing element along the second compression axis, the compression member of the second sealing element is folded, whereby the compression chambers move essentially along the second compression axis.

10. The sliding element according to claim 1, further comprising:

a second sealing element, separate and distinct from the at least one sealing element, extending along a lower edge of the sliding element, the second sealing element comprising:

an anchor member and a compression member;

at least two compression chambers that are arranged one upon the other along a related compression axis; and one or two bending folds or a plurality of mutually displaced bending folds arranged alternately on opposite sides of the compression member of the second sealing element, wherein the bending fold or the bending folds and the compression chambers are designed such that, during a displacement of the second sealing element along the related compression axis, the compression member of the second sealing element is foldable, and the compression chambers are movable during folding essentially along the related compression axis.

11. The sliding element according to claim 10, wherein the bending fold or the bending folds are aligned so as to be inclined, perpendicular to the related compression axis.

12. The sliding element according to claim 10, wherein the bending fold or one of the bending folds lies along the related compression axis between the compression chambers.

13. The sliding element according to claim 10, wherein the related compression axis traverses the anchor member and the compression member of the second sealing element.

14. The sliding element according to claim 10, wherein between the anchor member and the compression member of the second sealing element a shoulder member is provided that is aligned perpendicular to the related compression axis.

* * * * *